United States Patent [19]

Kubitzek et al.

[11] 4,102,965

[45] Jul. 25, 1978

[54] PROCESS FOR THE PRODUCTION OF POLYAMIDE-6-FILAMENTS OF THE γ-MODIFICATION

[75] Inventors: Harry Kubitzek; Karlheinz Feltgen; Friedrich-Karl Rosendahl, all of Dormagen, Germany

[73] Assignee: Bayer Aktiengesellschaft, Leverkusen, Germany

[21] Appl. No.: 665,852

[22] Filed: Mar. 10, 1976

[30] Foreign Application Priority Data

Mar. 13, 1975 [DE] Fed. Rep. of Germany ..... 2510917
Nov. 11, 1975 [DE] Fed. Rep. of Germany ..... 2550551

[51] Int. Cl.[2] ..... D02G 1/20

[52] U.S. Cl. ..... 264/103; 264/136; 264/210 F; 264/290 N

[58] Field of Search ..... 264/210 F, 103, 136, 264/290 N

[56] References Cited

U.S. PATENT DOCUMENTS

| | | | |
|---|---|---|---|
| 3,803,282 | 4/1974 | Hamana et al. | 264/210 F |
| 3,846,532 | 9/1974 | Kubitzek et al. | 264/210 F |
| 3,987,136 | 10/1976 | Schippers | 264/210 F |
| 3,994,121 | 11/1976 | Adams | 264/210 F |

FOREIGN PATENT DOCUMENTS

| | | | |
|---|---|---|---|
| 1,912,299 | 10/1969 | Fed. Rep. of Germany | 264/210 F |
| 1,069,696 | 5/1967 | United Kingdom | 264/210 F |

*Primary Examiner*—Jay H. Woo
*Attorney, Agent, or Firm*—Plumley and Tyner

[57] ABSTRACT

The invention is related to a process for the production of continuous polyamide-6-filaments present in the γ-modification both before and after stretching at room temperature by spinning polyamide-6 with a relative solution viscosity of from 2.3 to 3.1, preferably from 2.6 to 2.85, as measured on a 1% solution in m-cresol, wherein the filaments (a) after leaving the spinneret, are cooled by air-blowing and preoriented up to an elongation at break of from 50 to 80%, preferably from 55 to 75%, by being run off, preferably in the absence of godets, at a speed of 3700 to 4500 m/min; (b) before winding into package form and during take-off, are prepared with an aqueous preparation oil in such a way that they contain less than 3.0% by weight of water, and (c) before winding into package form are subjected to interlacing.

5 Claims, No Drawings

PROCESS FOR THE PRODUCTION OF POLYAMIDE-6-FILAMENTS OF THE γ-MODIFICATION

This invention relates to a high-speed spinning process for the production of polyamide-6-filament yarns of the γ-modification for the textile filament yarn sector, but especially for further processing into textured yarns by conventional stretch-texturing processes.

It is known from German Offenlegungsschrift No. 2,207,849 that textured continuous filaments can be produced from polyesters or polyamides by spinning the filaments from a multibore spinneret and running them off at a take-off rate of at least 2500 m/minute, pre-stretching them to a permanent elongation at break of 90 to 150% and processing the filaments thus pre-stretched and packaged by a false-twist process accompanied by further stretching. However, it has been found that the polyamide-6-filament yarn obtainable by the process outlined in German Offenlegungsschrift No. 2,207,849, with residual elongations of from 90 to 150%, barely accumulate in the requisite quality, because these filaments increase in length during spinning by taking up water either from the preparation applied to them or from the surrounding air, which results in loosening of the package during its actual formation, i.e. during the winding process, in increased fulling work where friction winders are used and, hence, in the uncontrolled development of heat on the package. The heat generated by fulling and friction can even result in melting of the filaments on the package. Even in the case of precision winders, i.e. winders with a directly driven winding mandrel, elongation of the filament produces more or less heavy deformation of the package through penetrating moisture, with the result that the package cannot be satisfactorily unwound.

It is also known that, in the conventional production of stretched, oriented polyamide-6-filaments, the filaments may initially be wound on to a spinning bobbin and oriented by stretching after a certain residence time in a particular atmosphere during which they precrystallise in the hexagonal γ-modification. The stretching process simultaneously induces in the filaments the α-monoclinic crystal modification which is regarded as thermodynamically the most stable, and an increase in the crystallinity from 5–10% to 25–30%.

The object of the present invention is to obviate the disadvantages referred to above and to produce for the textile sector polyamide-6-filament yarns with improved properties which are obtained in the highly oriented γ-modification which remains intact, even after stretching at room temperature.

Surprisingly, this object may be achieved by treating the filaments after they have left the spinneret by cooling, interlacing, reduced application of water and defined preorientation.

Accordingly, the present invention provides a process for the production of continuous polyamide-6-filaments present in the γ-modification both before and after stretching at room temperature by spinning polyamide-6 with a relative solution viscosity of from 2.3 to 3.1, preferably from 2.6 to 2.85, as measured on a 1% solution in m-cresol, wherein the filaments a. after leaving the spinneret, are cooled by air-blowing and preoriented up to an elongation at break of from 50 to 80%, preferably from 55 to 75%, by being run off, preferably in the absence of godets, at a speed of 3700 to 4500 m/minute;
b. before winding into package form and during take-off, are prepared with an aqueous preparation oil in such a way that they contain less than 3.0% by weight of water; and
c. before winding into package form are subjected to interlacing.

By adopting this procedure, the polyamide-6-filaments are obtained in the highly oriented γ-modification which remains intact, even after stretching at room temperature. This is certainly the case when, after winding into package form, the filaments do not show any (020)-reflex and when the intensity ratio of the (002) and (200) reflexes is above 1.1, i.e. when I(002):I(200) is greater than 1.1, and in addition when the orientation of the equatorial (200)-reflex, which is defined as the reciprocal value of half the width at half maximum intensity of the azimuthal intensity distribution of the (200)-reflex, is greater than 0.08 (Literature: L. E. Alexander: X-Ray Diffraction Methods in Polymer-Science, John Wiley and Sons, New York (1969), pages 241 et seq).

Accordingly, the present invention also provides preoriented polyamide-6-filaments of the γ-modification which do not show any (020) reflex in the $CuK_{\alpha}$-X-ray diagram either before or after stretching at room temperature, in which the intensity ratio of the (002) and (200) reflexes is above 1.1 and in which the orientation of the equatorial (200)-reflex, defined as the reciprocal value of half the width at half maximum intensity of the azimuthal intensity distribution of the (200)-reflex, is greater than 0.08.

These polyamide-6-filaments are also an object of the present invention.

These polyamide-6-filaments may be wound into package form without noticeable deformation of the package, they may be stored without any disadvantages and they may be further processed without any difficulties. Polyamide-6-filaments of this type are suitable for texturing by friction stretching and by other texturing processes combined with stretching, and also in the absence of further stretching for processing on warp-knitting and weaving machines. In cases where texturing is carried out by friction stretching, which is the preferred method of texturing the yarns according to the invention, the yarns may even be textured at a stretching ratio of 1:1.1. The most favourable stretching range comprises stretching ratios of from 1:1.1 to 1:1.5, preferably from 1:1.1 to 1:1.3. Accordingly, the invention also relates to the use of the polyamide-6-filaments according to the invention for consecutive or simultaneous stretch-texturing.

An important function in regard to achieving the object stated above in accordance with the invention is performed by the means by which the preparation is applied to the filaments. It must provide for the substantially constant application of oil and water to the filimants. One-way preparation techniques of the type described in German Offenlegungsschrifts Nos. 2,359,276 and 2,325,827 and in German patent application Nos. P 25 37 323.3 and P 25 37 324.4, are particular suitable for this purpose. One advantage in this respect is the greater distance than normal between the preparation unit and the winding unit.

Any standard commercial-grade preparation may be used providing it satisfies the usual requirements for use on filament yarns. It is advantageous to use those oil preparations which may be employed in concentrations of from 20 to 40%.

The measures described in steps (a), (b) and (c) of the process are essential for a favourable package structure and also for trouble-free further processing. Particularly favourable results are obtained in the denier ranges dtex22f5, 44 f 10 and 55 f 12. If these conditions are not observed, faults of various different kinds occur during the actual winding process or, as is the case for example with noninterlaced filaments, during further processing.

Whereas conditions (a), (b) and (c) have to be strictly observed, the atmosphere of the winding room may be varied within wide limits without any noticeable losses of quality or any reduction in the stretching yield, whereas in the conventional spinning of polyamide-6 at winding speeds of up to 1200 m/minute, the atmosphere prescribed for the winding room must be strictly maintained.

The filament material obtained by process stages (a), (b) and (c), which is suitable for further textile processing, has a boiling induced shrinkage after cold stretching approximately 1 to 2% lower than that of conventional polyamide-6-filament material. Accordingly, the textured yarn for example also has a lower boiling-induced shrinkage.

In addition, the filament yarns according to the invention show increased gloss after stretching at room temperature. For example dtex 44 f 10-filament yarns according to the invention containing 0.3% of $TiO_2$ have $G_{45}$-gloss values approximately 50 to 150% higher, and gloss levels (h) approximately 50 to 80% higher than filament yarns of the same denier produced from the same chip material by the conventional two-stage process ($G_{45}$- and h-measurements according to the publication of the Bekleidungsphysiologisches Institut E.V., 7121 Schloss Hohenstein, of February, 1970; Forschungsvorhaben Nr. 1823: "Untersuchungen zur Entwicklung einer Methode, um den Einfluss der Struktur von Polyester-Textilien auf den Glanz zu erfassen" [Research Project No. 1823 "Investigations into the Development of a Method for Determining the Influence of the Texture of Polyester Textiles on Gloss"]).

If a filament yarn produced according to the present invention is compared with a conventional yarn by texturing on the false-twisting internal friction method under conditions which are identical except for the degree of stretching predetermined by the different preorientations, ladies' stockings produced from the filament yarns according to the present invention are distinguished by their increased sheen, which is even visually noticeable, by their greater transparency and by the greatly reduced contraction between the unfinished and finished stocking.

Another advantage of the filament yarns produced in accordance with the invention is that their hexagonal γ-modification, for the development of which stages (a) and (b) of the process are responsible, remains intact even in the event of after-stretching at room temperature, whereas in the conventional process the γ-modification of the spun material is converted into the monoclinic α-modification during stretching under the effect of the water which diffuses in. This is reflected in the fact that the stretched filament yarns produced in accordance with the invention show greater tensile strength for comparable elongation at break and greater elongation at break for comparable tensile strengths than conventionally produced filament yarns. The better tensile values of these filament yarns are also apparent after stretch-texturing. In the filament yarns produced in accordance with the invention, the γ-modification frequently undergoes only partial conversion into the α-modification during finishing processes carried out under heat, such as texturing, dry and wet fixing, steaming, dyeing, etc. They may be processed directly, i.e. without further stretching, into warp-knit articles with a very even dye finish, whereas conventionallly produced polyamide-6-filament yarns with elongations at break of from 55 to 75% are virtually impossible to use in this sector.

The following Examples are to further illustrate the invention without limiting it.

EXAMPLE 1

Chips of polyamide-6 with a relative solution viscosity, as measured on a 1% solution in m-cresol, of 2.7 and containing 0.3% of $TiO_2$, were melted in a screen head and the resulting melt was spun at 280° C at a rate of 18.8 g/minute per spinneret from 10-bore spinnerets with bore diameters of 0.2 mm. After they had been cooled to 20° C by blowing with air, the filaments were treated with an aqueous preparation oil in such a way that the filaments contain 2.7% by weight of water and 0.8% by weight of preparation oil, interlaced and wound into package form directly, i.e. in the absence of godets, at 3905 m/minute using a friction winder. In the winding room, the temperature was 19° C and the humidity 49%. The filaments thus produced had the following properties:

| | | |
|---|---|---|
| Denier | 50.0 dtex | |
| tensile strength | 3.7 g/dtex | |
| elongation at break | 64.0 % | |
| (200)orientation | 0.106 | γ-modification |
| I(002) : I(200) | 1.45 | γ-modification |

The filaments were stretch-textured with a stretching ratio of 1 : 1.211 on the false-twisting friction principle and processed into ladies stockings on an 8-system hosiery knitting machine. The stockings had a clear stitch pattern and were extremely uniform. The contraction in length between unfinished and finished stockings amounted to 2.4%.

The filaments were then stretched in a ratio of 1:1.26 at room temperature on a stretch-twisting machine. The stretching yield was high. The filaments then had the following properties:

| | | |
|---|---|---|
| denier: | 43.50 dtex | |
| tensile strength: | 4.70 g/dtex | |
| elongation at break: | 38.00% | |
| (200)orientation: | 0.119 | γ-modification |
| I(002) : I(200): | 1.34 | γ-modification |
| $G_{45}$-value: | 30.9 | |
| h-value: | 20.9 | |

For comparison, filament yarns of 10 individual filaments with a gross denier of 136 dtex were produced from the same chips at a winding speed of 804 m/minute and stretched in a ratio of 1:3.29 at room temperature. These filaments, now in the α-modification, had the following properties:

| | |
|---|---|
| denier: | 43.00 dtex |
| tensile strength: | 4.26 g/dtex |
| elongation at break: | 38.00% |
| $G_{45}$-value: | 17.3 |

-continued

| | |
|---|---|
| h-value: | 13.5 |

EXAMPLE 2

In the same way as in Example 1, chips of polyamide-6 containing 1.45% of $TiO_2$ and having a relative solution viscosity of 2.72 were spun at a rate of 15.7 g/minute and wound into package form at 3800 m/minute at 22° C/60% relative humidity. The filaments which before winding were treated with an aqueous preparation oil in such a way that the filaments contain 2% by weight of water and 0.85% by weight of preparation oil and which before winding were interlaced had the following properties:

| | | |
|---|---|---|
| denier | 43.00 dtex | |
| tensile strength | 3.62 g/dtex | average values |
| elongation at break | 64.00 % | average values |
| (200)orientation | 0.095 to 0.098 | |
| I(002) : I(200) | 1.28 to 1.65 | |

Without further stretching, the filaments were processed into shirting which did not show any streakiness after dyeing with acid dyes.

EXAMPLE 3

In the same way as in Example 1, chips of polyamide-6 containing 0.3% of $TiO_2$ and having a relative solution viscosity of 2.67, as measured on a 1% solution in m-cresol, were melted in a screen head and the resulting melt extruded into filaments from 10-bore spinnerets with bore diameters of 0.25 mm in a quantity of 16.1 g/spinneret. By blowing them with air at room temperature, the filaments were cooled, treated with a 27% aqueous preparation oil in such a way that they contain 0.7% by weight of oil and 2% by weight of water, interlaced and wound into package form in the absence of godets at 4100 m/minute at 17° C/70% relative humidity. A shirting with a very even dye finish was produced from these filament yarns which had strengths of from 3.4 to 3.5 g/dtex and an elongation at break of 68%.

What we claim is:

1. A process for the production of continuous polyamide-6-filaments present in the γ-modification both before and after stretching at room temperature wherein polyamide-6 with a relative solution viscosity of from 2.3 to 3.1, preferably of from 2.6 to 2.85, as measured on a 1% solution in m-cresol as spun and wherein the resulting filaments a. after leaving the spinneret, are air-cooled and preoriented up to an elongation at break of from 50 to 80% by being run off at a speed of 3700 to 4500 m/minute, b. before winding into package form and during take-off, the filaments are prepared with an aqueous preparation oil in such a way that they contain less than 3.0% by weight of water, and before winding into package form the filaments are subjected to interlacing.

2. A process as claimed in claim 1, wherein the filaments are preoriented up to an elongation at break of from 55 to 75%.

3. A process for preparing a stretch-textured filament yarn wherein filaments as claimed in claim 1 are consecutively or simultaneously stretched and textured.

4. A process as claimed in claim 1 wherein stretching is carried out in a ratio of from 1 : 1.1 to 1 : 1.5 either before or during texturing.

5. A process as claimed in claim 1 wherein the stretching ratio is 1 : 1.1 to 1 : 1.3.

* * * * *